US005371485A

United States Patent [19]

Manimalethu

[11] Patent Number: 5,371,485

[45] Date of Patent: Dec. 6, 1994

[54] TWO CORE PHASE ANGLE REGULATING TRANSFORMER

[75] Inventor: Abraham I. Manimalethu, Muncie, Ind.

[73] Assignee: ABB Power T&D Company, Inc., Blue Bell, Pa.

[21] Appl. No.: 53,011

[22] Filed: Apr. 27, 1993

[51] Int. Cl.[5] ..... H01F 27/28

[52] U.S. Cl. ..... 336/180; 336/170

[58] Field of Search ..... 336/145, 146, 147, 149, 336/150, 170, 180

[56] References Cited

U.S. PATENT DOCUMENTS 2,418,643 4/1947 Huge .
4,403,205 9/1983 Leibinger et al. .
5,239,288 8/1993 Tsals ..... 336/120

*Primary Examiner*—Leo P. Picard
*Assistant Examiner*—L. Thomas
*Attorney, Agent, or Firm*—Ostrolenk, Faber, Gerb & Soffen

[57] ABSTRACT

An improved phase angle regulator with about 70% of the total impedance in the series unit and 30% in the excitor unit. In order to balance the physical size of both units, the excitor unit includes an interleaved winding arrangement. On large phase angle regulators, the higher impedance in the series unit allows for the use of a three-leg core design, and the low impedance interleaved excitor unit can also be designed on a three-leg core. The higher impedance series unit reduces the zero sequence current in the unit by about 40% during a single line to ground fault. Also the interleaved winding arrangement in the excitor unit improves its short circuit withstand capability.

3 Claims, 4 Drawing Sheets

TWO CORE PHASE ANGLE REGULATING TRANSFORMER

BACKGROUND OF THE INVENTION

1. Field of the Invention

The present invention relates to electrical transformers and, more particularly, to an electrical transformer having improved short circuit withstand capability through reduced zero sequence current.

2. Description of the Related Art

A conventional two core phase angle regulating transformer consist of an excitor unit and a series unit mounted on separate cores. The excitor unit establishes flux which is transferred to the series unit. The amount of flux transferred from the excitor unit to the series unit determines the phase shift in the series unit. Typically, a two core phase angle regulating transformer is designed for about 50% of total impedance in the excitor unit and 50% in the series unit, so as to balance the physical size of the two units. Both units are connected by cables running in a throat between the two units. The zero sequence reactance of this type of design is a constant. The delta connected secondary winding of the series unit prevents the flow of zero sequence current to the excitor unit. As a result of this, the zero sequence reactance of the phase angle regulator is approximately the zero sequence reactance of the series unit.

During a single line to ground fault, zero sequence current will not flow into the excitor unit and the series unit must be designed to take the full zero sequence current. Since the series unit is designed for 50% of the total phase angle regulator impedance, it should be designed for the short circuit current corresponding to this low impedance. In addition to this, the insulation characteristics of the delta connected secondary winding in the series unit will ordinarily require a 5-leg core design for the series unit, on large phase angle regulating transformers. In order to keep the physical size of the two units the same, the excitor unit will also be designed on a 5-leg core.

A five leg core, however, has three main legs with coils and two outer legs without coils. Accordingly, it has a higher sound level, higher losses, and it uses more material. The tank for housing the transformer must necessarily be longer, and an increased amount of oil is needed to insulate and cool the transformer. The cost of such a transformer is correspondingly higher than for a three leg transformer.

SUMMARY OF THE INVENTION

Accordingly, it is an object of the present invention to provide an improved phase angle regulator transformer with about 70% of the total impedance in the series unit and 30% of the total impedance in the excitor unit while, at the same time, maintaining a three-leg core for both the series and the excitor units.

The present invention achieves the foregoing objective by utilizing an interleaved winding arrangement in the excitor unit. The higher impedance (70% of total) in the series unit allows the use of a three-leg core design, and the interleaved arrangement allows the low impedance (30% of total) excitor unit to also be designed on a three-leg core.

Advantageously, the higher impedance series unit will reduce the zero sequence current in the unit by about 40% during a single line to ground fault. Also, the interleaved winding arrangement in the excitor unit will improve its short circuit withstand capability.

Other features and advantages of the present invention will become apparent from the following description of the invention when read in conjunction with the accompanying drawings.

DETAILED DESCRIPTION OF THE PREFERRED EMBODIMENTS

Figure 1A:
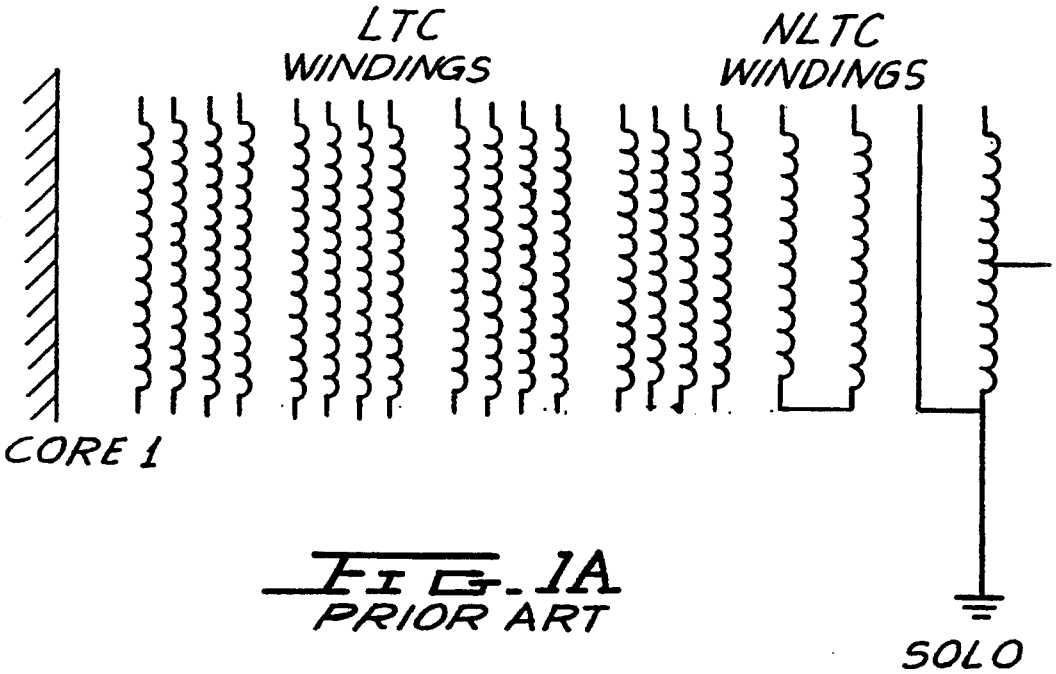
FIG. 1A PRIOR ART
FIGS. 1A and 1B are schematic illustrations of a conventional winding arrangement of an electrical transformer, showing, respectively, an exciter unit (middle leg) and a series unit (also middle leg).
Figure 1B:
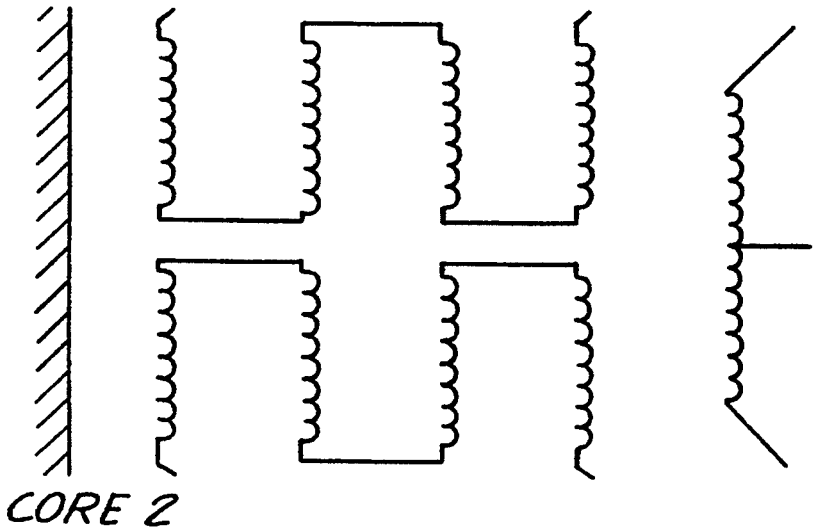
FIG. 1B PRIOR ART
Figure 2A:
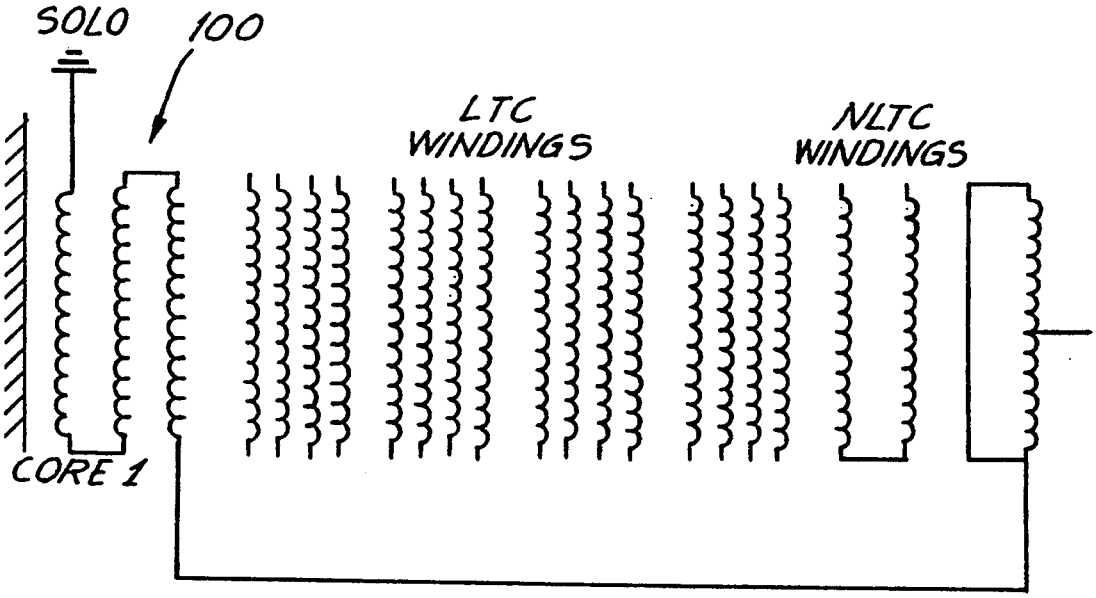
FIGS. 2A and 2B are schematic illustrations of an improved winding arrangement of an electrical transformer in accordance with the present invention, showing, respectively, an exciter unit and series unit for the same.
Figure 2B:
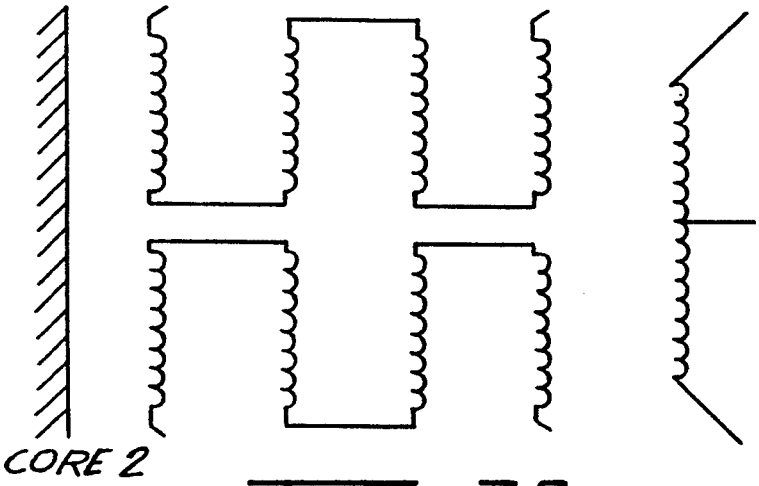

Referring now to the drawings, in which like numerals indicate like elements and encircled letters indicate connected elements, FIGS. 1A and 1B show a conventional winding arrangement for the middle leg of a phase angle regulating transformer, and FIGS. 2A and 2B show the improved winding arrangement of the present invention.

As is evident from a comparison of FIGS. 1A/1B and FIGS. 2A/2B, the improved winding arrangement of the invention includes an interleaved arrangement in the excitor unit, identified by reference numeral 100, not present in the conventional arrangement. This difference is also evidence from a comparison of FIGS. 3 and 4, which, again, show the inclusion of interleaved arrangement 100 in the present invention (FIG. 4), but not in a conventional arrangement (FIG. 3).

Figure 3:
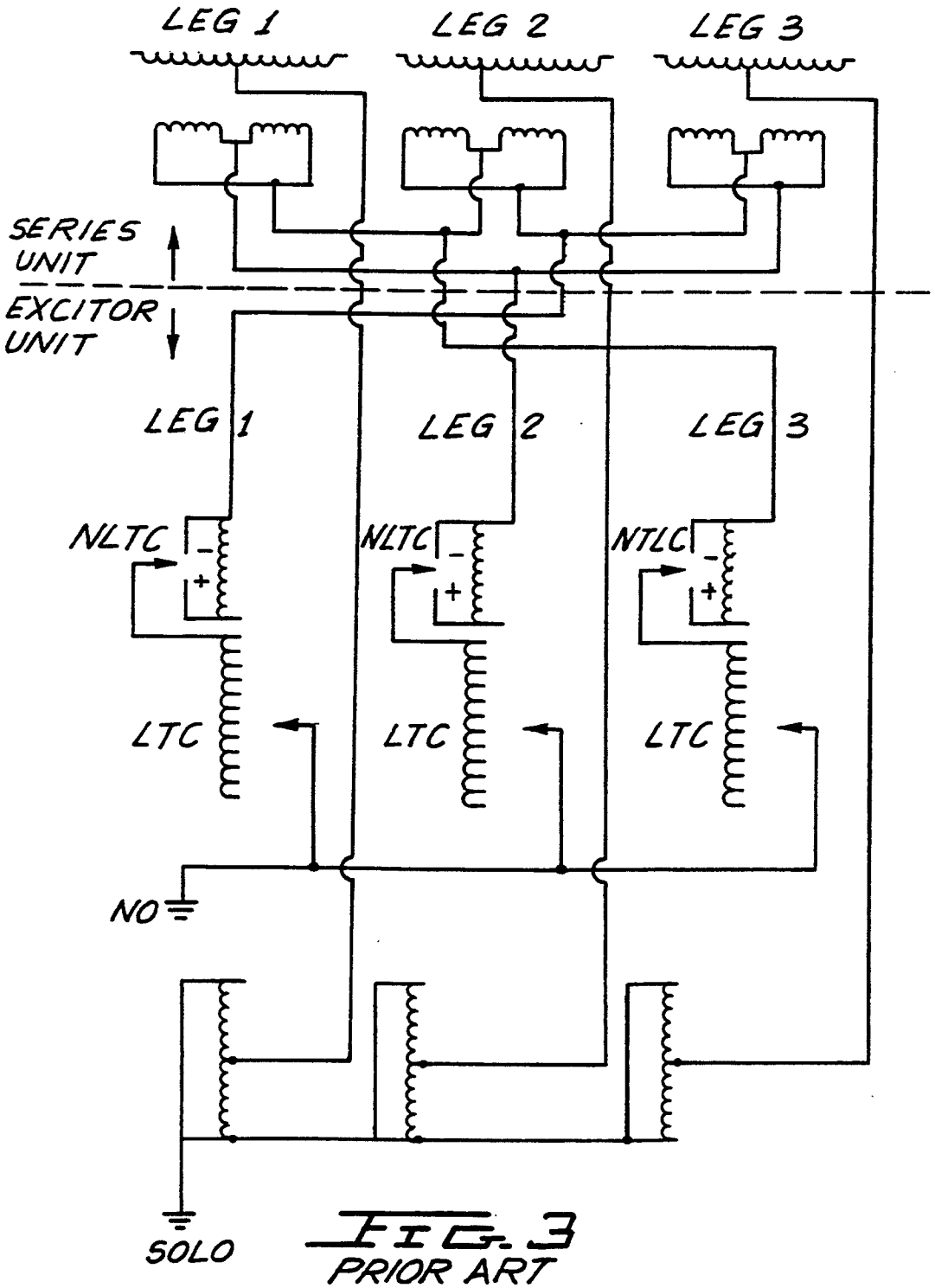
FIG. 3 PRIOR ART
FIG. 3 is a schematic illustration of the circuitry of a conventional transformer winding arrangement.
Figure 4:
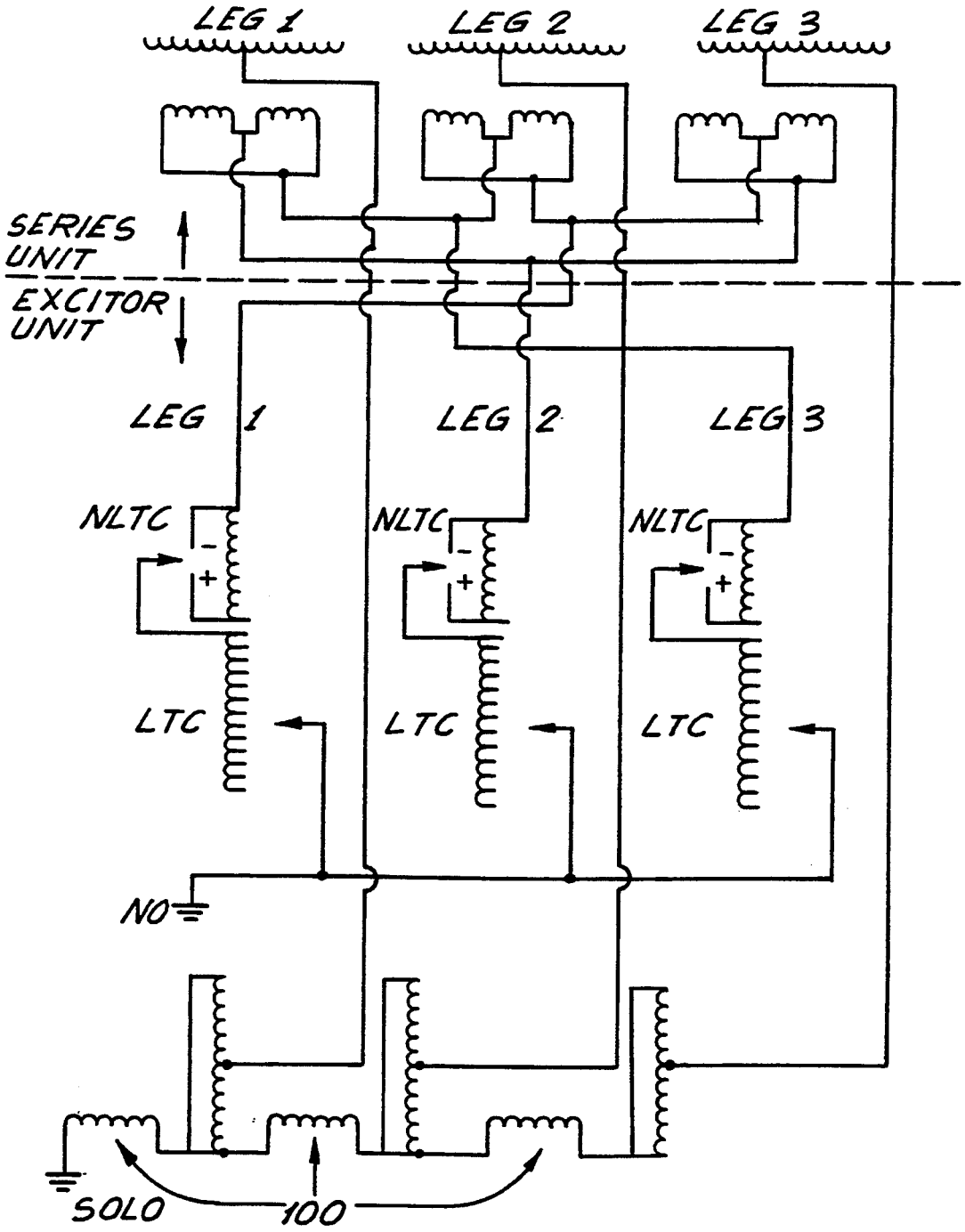
FIG. 4 is a schematic illustration of the circuitry of the transformer winding arrangement of the invention.

Both the excitor unit in the prior art arrangement (FIG. 1A) and the excitor unit of the present invention (FIG. 1B) include load tap changer (LTC) windings adjacent the core and no load tap changer (NLTC) windings adjacent the LTC windings. Changing the taps in the LTC and NLTC windings of the excitor unit alters the amount of flux transferred from the excitor to the series unit, thereby changing the phase shift in the series unit. The LTC windings can be changed automatically while the system is operating (i.e., under load), while the NLTC windings can only be changed manually when the system is turned off (i.e., under no load conditions). The LTC and NLTC winding are also shown in FIGS. 3 and 4, which depict all three legs of the series and excitor units in a conventional two core phase angle regulating transformer (FIG. 3) and the two core phase angle regulating transformer of the present invention (FIG. 4).

As discussed previously, the interleaved arrangement of the excitor unit permits a shift of impedance from a 50/50 percent split between the series unit and the excitor unit to a 70/30 percent split, while maintaining the low impedance (30%) excitor unit on a three-leg core.

As a result of the delta connection that is used in the secondary of the series unit, the zero sequence reactance is independent of the phase shift for the regulator, and is a constant for the two core design of the invention. This is because zero sequence currents cannot flow out of or into a delta winding; thus, the excitor transformer is essentially isolated.

Accordingly, the only component of zero sequence reactance is that of the series unit of the transformer. In contrast to the conventional design in which 50% of the reactance is used for the series unit, the present invention uses 70% of the reactance for the series unit. Since short circuit current varies inversely with reactance, the higher reactance of the series unit advantageously reduces zero sequence circuit for single line to ground faults.

Also, because short circuit forces are dependent on the square of current (and the square of ampere-turns (NI)), the interleaved winding arrangement in the excitor unit (which reduces the maximum NI) improves the short circuit withstand capability of the transformer.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A two core phase angle regulating transformer having a total impedance, said transformer comprising:

an excitor unit for establishing flux, said excitor unit having a first impedance and being mounted on a first core, said excitor unit including an interleaved winding arrangement; and a series unit electrically coupled to said excitor unit and receiving flux therefrom, said series unit changing the phase angle of electrical power in a transmission line in accordance with the flux received from said excitor unit, said series unit having a second impedance and being mounted on a second core;

wherein said first and second cores have an equal number of legs, and wherein said first impedance of said excitor unit comprises less than 50% of the total impedance of said transformer and said second impedance of said series unit comprises greater than 50% of the total impedance of said transformer.

2. A two core phase angle regulating transformer as recited in claim 1, wherein said first and second cores each have three legs.

3. A two core phase angle regulating transformer as recited in claim 1, wherein 70% of the total impedance of said transformer is in the series unit and 30% of the total impedance of said transformer is in the excitor unit.

* * * * *